US007364325B2

(12) United States Patent
Lai

(10) Patent No.: US 7,364,325 B2
(45) Date of Patent: Apr. 29, 2008

(54) LAMP STRUCTURE

(76) Inventor: Li-Chun Lai, 21F-1, No. 33, Sec. 1, Minsheng Rd., Panciao City, Taipei County (TW)

( * ) Notice: Subject to any disclaimer, the term of this patent is extended or adjusted under 35 U.S.C. 154(b) by 87 days.

(21) Appl. No.: 11/336,808

(22) Filed: Jan. 23, 2006

(65) Prior Publication Data

US 2007/0171655 A1 Jul. 26, 2007

(51) Int. Cl.
*F21V 15/00* (2006.01)

(52) U.S. Cl. ..... 362/285; 362/427

(58) Field of Classification Search ..... 362/419, 362/250, 285, 275, 401, 402, 368, 388, 427
See application file for complete search history.

(56) References Cited

U.S. PATENT DOCUMENTS 5,586,820 A * 12/1996 Klink ..... 362/402
5,695,279 A * 12/1997 Sonnleitner et al. ..... 362/419
6,644,827 B2 * 11/2003 Birdwell ..... 362/202

* cited by examiner

*Primary Examiner*—Anabel M Ton

(57) ABSTRACT

A lamp structure is constructed to include a transparent opencell housing with a predetermined wall thickness. The housing includes an inner mirror layer and an outer mirror layer respectively coated on the inner and outer surfaces thereof. A light admitting face in the outside peripheral rim thereof neighbors the mirror layers, and a light source installed in a lamp socket is formed integral with the housing and controlled to emit light into the predetermined wall thickness, for enabling light rays to be mutually reflected between the mirror layers and guided toward the light admitting face in the outside peripheral rim of the housing to form a light ring.

6 Claims, 4 Drawing Sheets

LAMP STRUCTURE

BACKGROUND OF THE INVENTION

1. Field of the Invention

The present invention relates to a lamp structure and, more particularly, to a lamp structure with a base having adjustable front, rear, left and right angles to provide a required illumination angles.

2. Description of Related Art

A conventional outdoor lamp for gardens mainly contains a base, for connecting a lamp body, and a ground spike, wherein the base is pivoted to the ground spike so as for the base to move forward and backward on the ground spike. When used, the ground spike is embedded in outdoor sods, gravels or sand lands to position the base, so that the lamp body on the base may generate a light source for illuminating in the dark. However, the conventional lamp has the function of illumination, though; it possesses adjustable property with respect to the front and rear angles only whereas it cannot rotate leftward and rightward and, thus, the illumination angles of the lamp are restricted to a deficient practicality.

Therefore, the conventional articles aforesaid have still many drawbacks and, indeed, lack an ideal design so that an improvement is desirable.

The inventors have endeavored to innovate in view of the various shortcomings derived from the aforesaid conventional lamps and, eventually, developed the present lamp structure successfully through years of exhausting research.

SUMMARY OF THE INVENTION

The present invention is to provide a lamp structure with a base having adjustable illumination angles to provide a multi-angled illumination so that the illumination in the night may encompass a variety of angles.

Another, the present invention is to provide a lamp structure, which is simply structured, easily operational and highly practicable.

The lamp structure of the present invention comprises a base, a holder, and a ground spike, wherein the base is associated with a lamp connected to the top thereof and a rotatory disk pivoted to the bottom thereof so that the base may move forward and backward on the rotatory disk. The rotatory disk has a hollow exerted cylinder extending from the bottom surface thereof, the hollow exerted cylinder having a baffle extending from the periphery thereof and a hollow pivot extending at the center thereof so as to form a positioning groove between the hollow exerted cylinder and the hollow pivot; and has a locking piece extending from the edge thereof. The holder has a cascade recess formed thereon, the recess containing a hollow cylinder extending at the center thereof and having a plurality of wave-like locking grooves disposed on the periphery thereof, the hollow cylinder being accompanied with an arced plate extending near one side thereof. The ground spike is connected to the bottom surface of the holder.

In the present invention, the rotatory disk is pivoted to the holder for the rotatory disk to be positioned at the upper level of the recess of the holder, and for the positioning groove on the rotatory disk to socket the hollow cylinder of the holder so that the hollow pivot may penetrate the hollow cylinder. Thus, the rotatory disk may rotate leftward and rightward on the holder. During the rotation, the baffle of the rotatory disk is baffled by the arced plate of the holder to restrict the rotation angles of the rotatory disk while the locking piece of the rotatory disk is always locked to one of the locking grooves of the holder to position the rotatory disk. In the present invention, the lamp base is held on the ground by the ground spike and adjusted to the required angles by the features thereof that it may move forward and backward and rotate leftward and rightward for providing the most preferable illumination angles.

Other objects, advantages, and novel features of the invention will become more apparent from the following detailed description when taken in conjunction with the accompanying drawings.

These features and advantages of the present invention will be fully understood and appreciated from the following detailed description of the accompanying Drawings.

DETAILED DESCRIPTION OF THE PREFERRED EMBODIMENT

Figure 1:
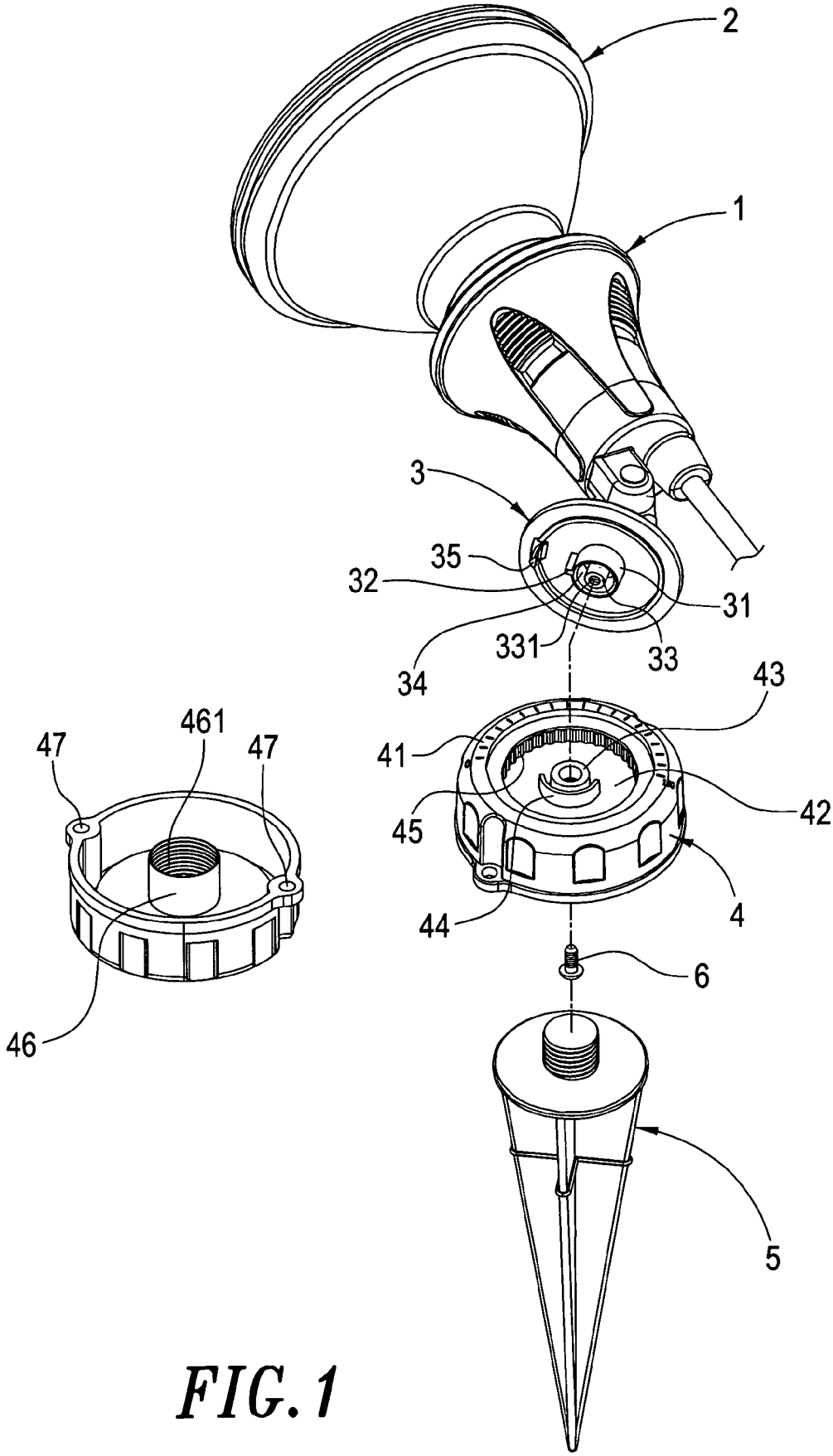
FIG. 1 is an exploded diagram of the lamp structure according to the present invention.
Figure 2:
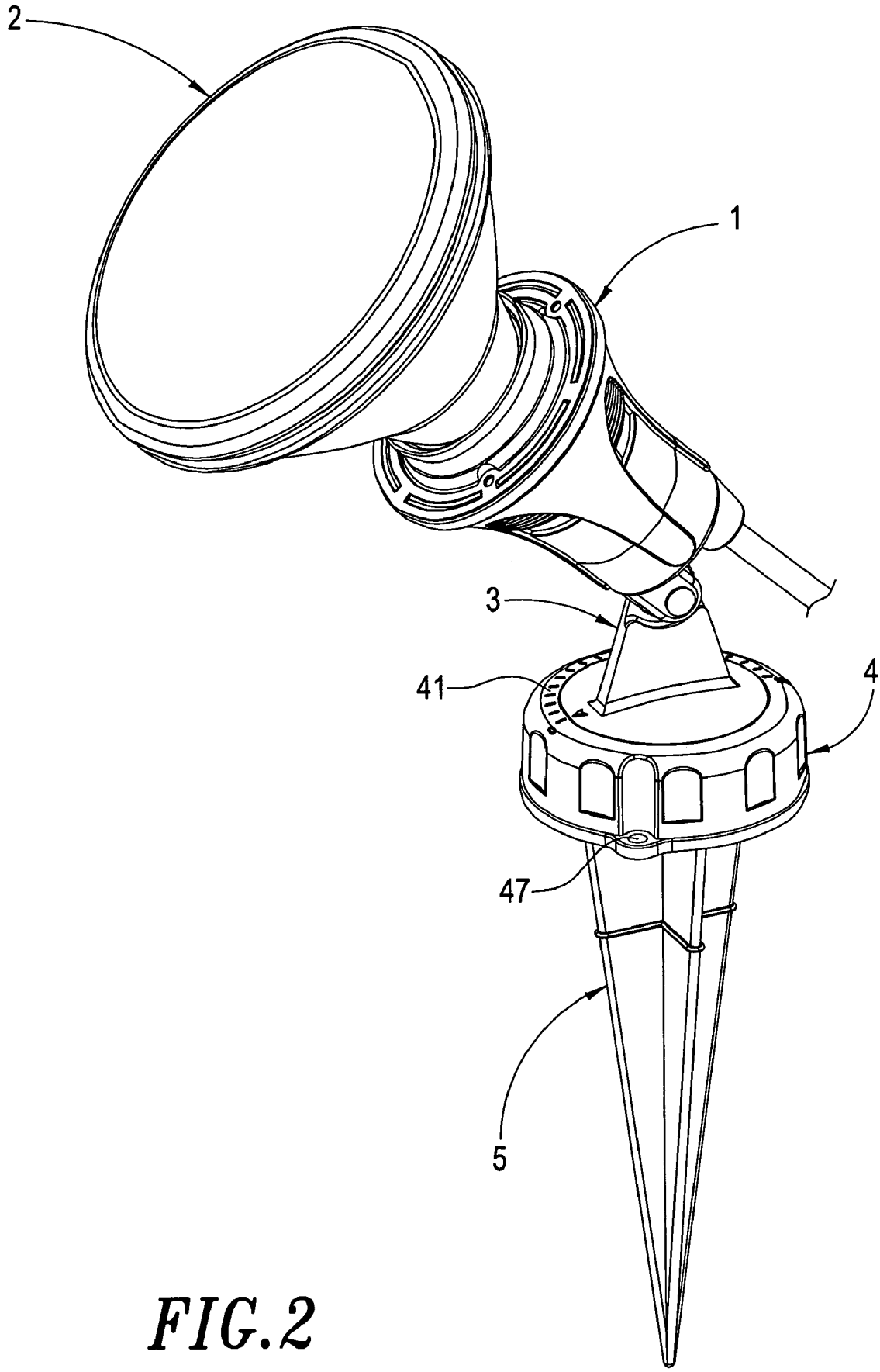
FIG. 2 is a pictorial diagram of the lamp structure according to the present invention.
Figure 3A:
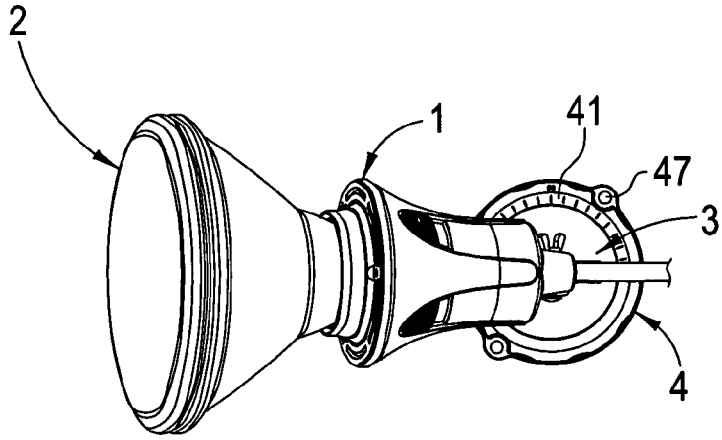
FIG. 3A-3C are diagrams illustrating the base rotation of the lamp structure according to the present invention.
Figure 3B:
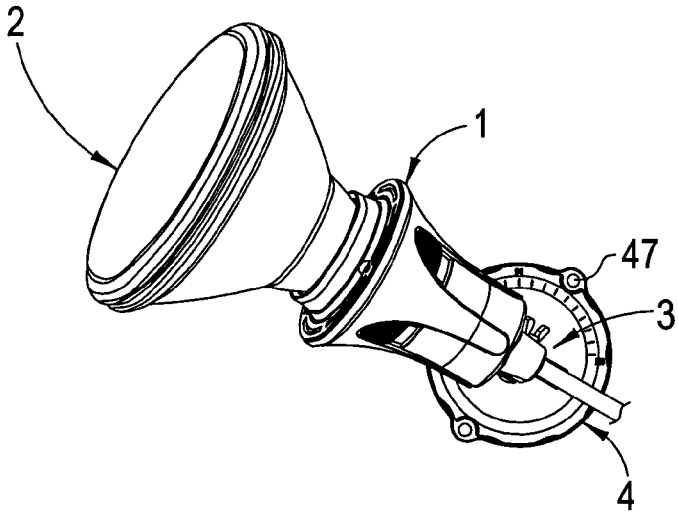
Figure 3C:
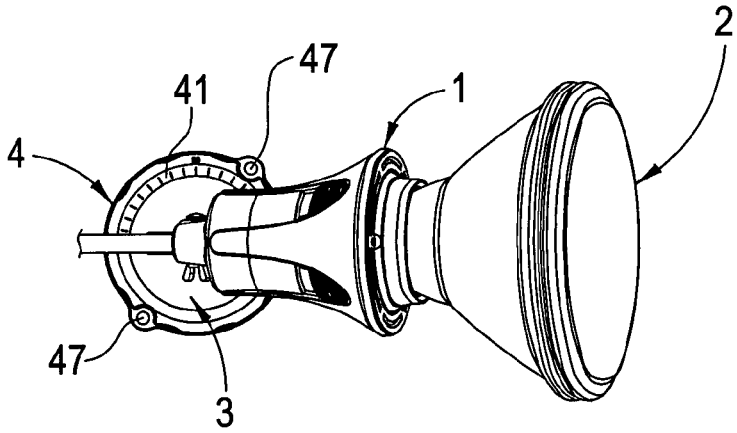
Figure 4A:
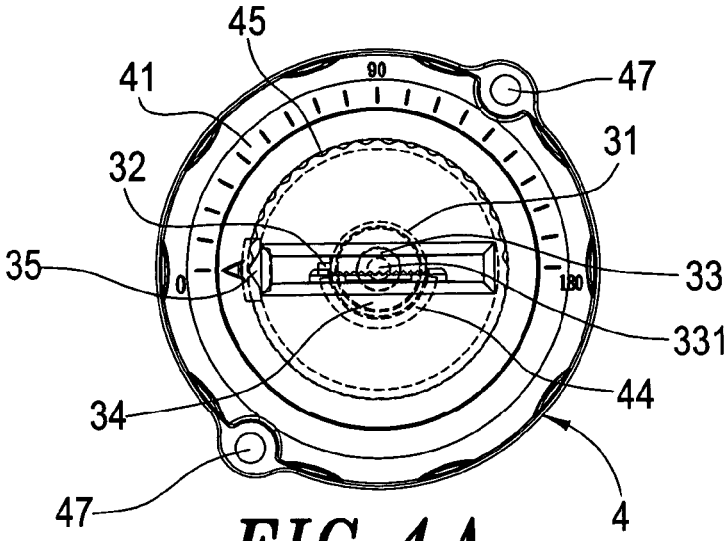
FIG. 4A-4C are diagrams illustrating the rotatory disk rotation of the lamp structure according to the present invention.
Figure 4B:
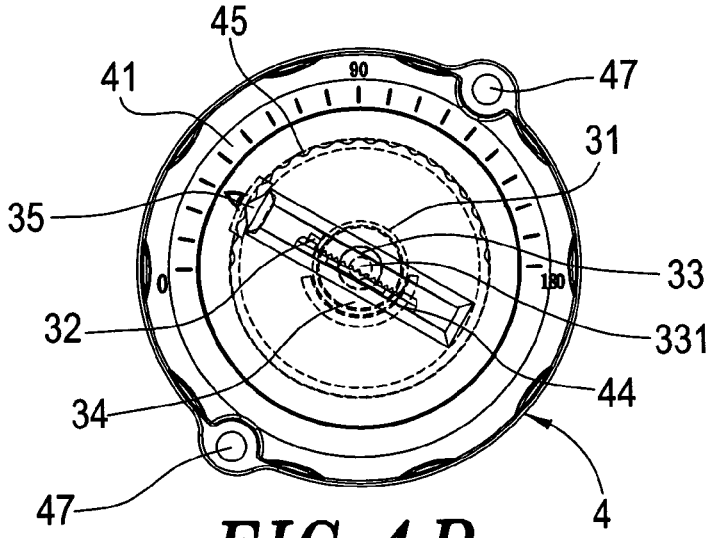
Figure 4C:
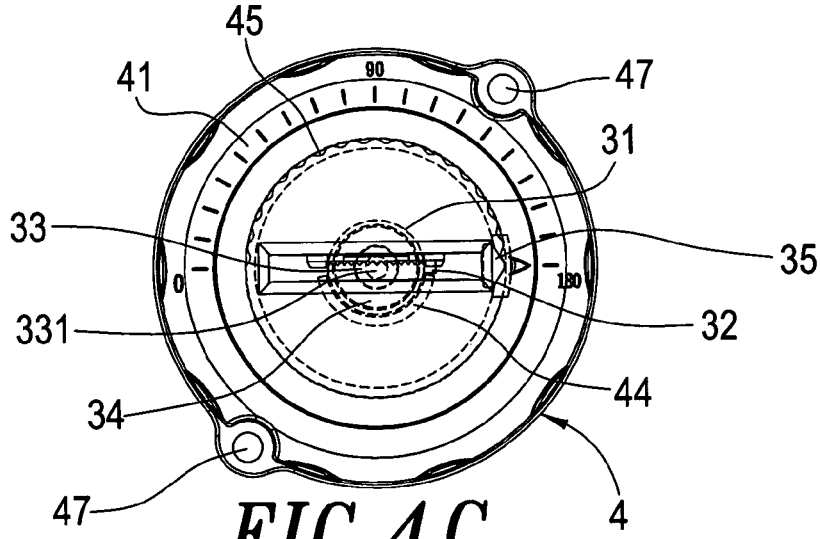

Referring to FIG. 1 and FIG. 2, they illustrate the lamp structure provided by the present invention, the lamp structure mainly comprises a base 1 and a holder 4.

The base 1 is associated with a lamp 2 connected to the top thereof and with a rotatory disk 3 pivoted to the bottom thereof so that the base 1 may move forward and backward on the rotatory disk 3. The rotatory disk 3 has a hollow exerted cylinder 31 extending from the bottom surface thereof. The hollow exerted cylinder 31 has a baffle 32 extending from the periphery thereof and has a hollow pivot 33 extending at the center thereof so as to form a positioning groove 34 between the hollow exerted cylinder 31 and the hollow pivot 33. The hollow pivot 33 has a diameter smaller than the hollow exerted cylinder 31 and has a thread 331 disposed thereinside and has a locking piece 35 extending from the edge thereof.

The holder 4 has an angle index 41 on the periphery of the top surface thereof and has a cascade recess 42 formed thereon. That is, the recess 42 of the holder 4 is cascaded. The recess 42 contains a hollow cylinder 43 extending at the center of the lower level thereof. The hollow cylinder 43 is accompanied with an arced plate 44 extending near one side thereof. The arced plate 44 has a length to limit the rotation angle of the rotatory disk 3, and has a plurality of wave-like locking grooves 45 disposed on the periphery of the lower level thereof. The locking grooves 45 has a length depending on the rotation angle of the rotatory disk 3. The holder 4 further has a hollow positioning cylinder 46 extending from the bottom surface thereof. The hollow positioning cylinder 46 has a thread 461 disposed there inside for fastening a ground spike 5. The holder 4 still further has a fixing hole 47 on each side thereof such that the holder 4 may be secured into a wall or ground directly by fasteners (not shown) with no need of being linked to the ground spike 5.

The rotatory disk 3 is pivoted to the holder 4 for the rotatory disk 3 to cover and to be positioned at the upper level of the recess 42 of the holder 4, and for the positioning groove 34 on the bottom surface of the rotatory disk 3 to socket the hollow cylinder 43 of the holder 4 so that the hollow pivot 33 of the rotatory disk 3 may penetrate the hollow cylinder 43 and the rotatory disk 3 may be securely pivoted to the recess 42 of the holder 4 and rotate the base 1 leftward and rightward on the holder 4 with the locking piece 35 of the rotatory disk 3 being always locked to one of the locking grooves 45 of the holder 4 to position the rotatory disk 3.

Referring to FIG. 3A-3C and FIG. 4A-3C, they are diagrams illustrating the operation according to the present invention. The user may have the lamp base 1 held on the outdoor sods, gravels or sand lands by the ground spike 5 or, alternatively, have the holder 4 secured on the wall or ground, and adjust the base 1 by the front, rear, left and right angles thereof. When the rotatory disk 3 rotates the base 1 leftward or rightward, the baffle 32 on the bottom surface of the rotatory disk 3 is always baffled by the arced plate 44 of the holder 4 to restrict the rotation angles of the rotatory disk 3 by the arced plate 44 while the locking piece 35 of the rotatory disk 3 is always locked to one of the locking grooves 45 on the periphery of the recess 42 of the holder 4, so that the base 1 may be positioned to attain the required illumination angle and thus achieve the wide-angle illumnination.

On the other hand, in the present invention the baffle 32 and the arced plate 44 may be undone optionally, so that the rotatory disk 3 can rotate the base 1 by 360 degrees.

The lamp structure provides by present invention, as compared with other conventional technologies, has the following advantages:

1. According to the present invention, the illumination angle of the lump base may be adjusted suitably, so that the illumination in the night may encompass a variety of angles.

2. The present invention provides a lamp structure, which is simply structured, easily operational and highly practicable.

Many changes and modifications in the above-described embodiment of the present invention can, of course, be carried out without departing from the scope thereof. Accordingly, to promote the progress in science and the useful arts, the invention is disclosed and is intended to undergo limitation only by the scope of the appended claims.

What is claimed is:

1. A lamp structure comprising:

a base, being associated with a lamp connected to the top thereof and with a rotatory disk pivoted to the bottom thereof, wherein the rotatory disk has a hollow exerted cylinder extending from the bottom surface thereof, the hollow exerted cylinder having a hollow pivot extending at the center thereof so as to form a positioning groove between the hollow exerted cylinder and the hollow pivot, the hollow pivot having a diameter smaller than the hollow exerted cylinder; and a holder, having a recess formed thereon, wherein the recess contains a hollow cylinder extending at the center of the lower level thereof, wherein the rotatory disk is pivoted to the holder for the hollow cylinder of the holder to be received in the positioning groove on the bottom surface of the rotatory disk so that the hollow pivot of the rotatory disk can penetrate the hollow cylinder and the rotatory disk can rotate the base leftward and rightward on the holder, and wheren the recess of the holder is cascaded.

2. The lamp structure as claimed in claim 1, wherein the hollow exerted cylinder of the rotatory disk has a baffle extending from the periphery thereof and the hollow cylinder of the holder is accompanied with an arced plate extending near one side thereof so that when the rotatory disk rotates leftward or rightward, the baffle is always baffled by the arced plate to restrict the rotation angles of the rotatory disk.

3. The lamp structure as claimed in claim 1, wherein the rotatory disk has a locking piece extending from the edge thereof and the recess of the holder has a plurality of wave-like locking grooves disposed on the periphery thereof so that when the rotatory disk rotates leftward or rightward, the locking piece is always locked to one of the locking grooves to position the rotatory disk.

4. The lamp structure as claimed in claim 1, wherein the holder has an angle index on the periphery of the top surface thereof for indicating the rotation angle.

5. The lamp structure as claimed in claim 1, wherein the holder has a hollow positioning cylinder extending from the bottom surface thereof, the hollow positioning cylinder having a thread disposed there inside for fastening a ground spike.

6. The lamp structure as claimed in claim 1, wherein the holder has a fixing hole on each side thereof such that the holder can be secured into a wall or ground directly by fasteners.

* * * * *